United States Patent [19]

Copenhaver

[11] 4,403,599

[45] Sep. 13, 1983

[54] SPILLAGE DAMPER FOR A COMBUSTION SYSTEM

[75] Inventor: Lloyd F. Copenhaver, Indianapolis, Ind.

[73] Assignee: Carrier Corporation, Syracuse, N.Y.

[21] Appl. No.: 207,855

[22] Filed: Nov. 18, 1980

[51] Int. Cl.[3] ..... F23J 11/00

[52] U.S. Cl. ..... 126/312; 110/162; 126/293; 236/45

[58] Field of Search ..... 126/293, 285 R, 289, 126/99 R, 312, 299, 307 R, 307 A; 236/45, 49, 1 G; 110/173 B, 162; 98/66 R, 60; 431/20

[56] References Cited

U.S. PATENT DOCUMENTS

| | | | |
|---|---|---|---|
| 411,447 | 9/1889 | Johnson et al. | 110/173 B |
| 524,248 | 8/1894 | Harkins | 110/173 B |
| 1,717,658 | 6/1929 | Bryant | 110/173 B |
| 1,830,857 | 11/1931 | Schmidt | 98/66 R |
| 1,837,485 | 12/1931 | Rember | 110/173 B |
| 1,837,581 | 12/1931 | Peterson | 126/312 |
| 2,623,482 | 12/1952 | Ayers | 110/173 B |
| 2,913,044 | 11/1959 | Mobley | 431/20 |
| 2,956,132 | 10/1960 | Hilgert | 431/20 |
| 4,189,296 | 2/1980 | Hayes | 431/20 |
| 4,267,965 | 5/1981 | Everett | 431/20 |
| 4,334,855 | 6/1982 | Nelson | 431/20 |

FOREIGN PATENT DOCUMENTS

| | | | |
|---|---|---|---|
| 797453 | 7/1958 | United Kingdom | 236/45 |

*Primary Examiner*—James C. Yeung

*Attorney, Agent, or Firm*—Donald F. Daley; David L. Adour

[57] ABSTRACT

An apparatus is disclosed for use in venting the products of combustion from a power combustion system such as an induced draft furnace. The apparatus includes a housing having three openings and a baffle. One opening in the housing receives the gaseous products of combustion from the power combustion system. A second opening in the housing is connected to a flue pipe which directs the products of combustion from the housing to an outlet vent. The third opening in the housing has a spillage damper or movable panel which can cover the third opening. The panel is pivotally connected to the outside of the housing above the third opening. When the pressure within the housing is less than the surrounding atmospheric pressure the panel is forced closed by this pressure. The panel is forced open and the products of combustion in the housing are vented to the surrounding atmosphere when a pressure greater than the surrounding atmospheric pressure is present within the housing. The baffle is located within the housing near the first opening and directs flow through the housing from the first opening to the second opening.

3 Claims, 2 Drawing Figures

SPILLAGE DAMPER FOR A COMBUSTION SYSTEM

BACKGROUND OF THE INVENTION

This invention relates to combustion systems and more particularly to an apparatus for venting the gaseous products of combustion from a combustion system. Specifically, this invention relates to a spillage damper for use in venting the gaseous products of combustion from an induced draft combustion system, such as a furnace.

A combustion system or furnace normally contains a combustion chamber wherein fuel, such as natural gas or oil, is burned creating hot gaseous products of combustion, a heat exchanger wherein the heat from the products of combustion are transferred to another medium such as air or water, and a flue or venting system wherein the gases, now referred to as flue gases, pass from the heat exchanger to atmosphere at a remote location. In a natural draft combustion system the flue gases usually are collected at a draft hood after the gases have passed over a heat exchanger. The draft hood is connected to a flue pipe whereby the flue gases are drawn into the flue pipe from the draft hood due to the natural draft of the flue pipe. In a forced draft combustion system a fan is located upstream of the combustion chamber and the heat exchanger and forces air into the combustion chamber and the products of combustion through the heat exchanger into the flue. In an induced draft combustion system a fan is located between the heat exchanger and the flue and draws air into the combustion chamber and draws the products of combustion through the heat exchanger into the flue. The forced draft and induced draft combustion systems are generally referred to as power draft combustion systems.

In the natural draft system the flue or vent system usually contains a means, such as a draft hood or draft diverter, for preventing pressure buildup in the flue system if the system is blocked. Draft hoods consist of an opening in the flue system covered by a hood. The opening allows the flue gases to vent to the atmosphere surrounding the furnace when pressure above atmospheric pressure builds up in the flue. When the flue is functioning normally the reduced pressure in the flue draws air through the opening into the draft hood and up the flue.

In addition to providing relief for pressure in the flue, the draft hood provides dilution of the products of combustion in the natural draft system. That is, the temperature and humidity of the products of combustion are reduced by mixing with air taken in through the draft hood opening. The air drawn into the flue through the draft hood opening is air which surrounds the furnace and is air which, in most instances, has been heated to room temperature. This, in effect, is a heat loss. That is, energy in the form of gas or oil has been used to heat the air which is subsequently drawn into the flue and expelled to the atmosphere. Reduction or elimination of this induced air reduces the heat loss and improves the system efficiency.

The draft hood or draft diverter of the natural draft combustion system may be used with a forced or induced draft combustion system. However, it is desirable to have an apparatus which provides the advantages of a draft hood or draft diverter such as relieving pressure in the vent system if the system should become blocked while eliminating or substantially reducing the heat loss associated with the draft hood or draft diverter and providing greater efficiency.

SUMMARY OF THE INVENTION

It is therefore an object of the present invention to eliminate or substantially reduce the amount of air drawn into the flue of a power draft combustion system, especially an induced draft combustion system.

It is another object of this invention to eliminate or substantially reduce air drawn into the flue of a power draft combustion system, especially an induced draft combustion system, without impairing the ability of the system to vent flue gases under conditions of flue blockage or increased pressure in the flue.

It is a further object of the present invention to provide an apparatus for use in venting gaseous products of combustion from a power combustion system, especially an induced draft combustion system, which satisfies the purposes of a conventional draft hood and eliminates the need for such a draft hood. The apparatus is designed so that the safety features of the draft hood are maintained while the heat loss associated with a draft hood is substantially reduced or eliminated.

It is a still further object of the present invention to provide an apparatus for use in connecting a conduit carrying gaseous products of combustion from an induced draft combustion system to an outlet vent. The apparatus allows the gaseous products of combustion from the induced draft combustion system to be vented to the air surrounding the induced draft system when a pressure greater than the surrounding atmospheric pressure is present in the apparatus and prevents the surrounding air from being drawn into the apparatus when the pressure in the apparatus is less than surrounding atmospheric pressure.

These and other objects of the present invention are attained by an apparatus comprising a housing having three openings and a baffle. One opening in the housing is for receiving gaseous products of combustion from a collector box which collects the products of combustion leaving the heat exchangers of the combustion system. A second opening in the housing is connected to a flue pipe which directs the products of combustion from the housing to an outlet vent. A third opening in the housing has a movable panel which can cover the opening and is pivotally connected to the outside of the housing above the third opening. The panel is connected so that the panel is forced open and the products of combustion weithin the housing are discharged to the surrounding atmosphere when a pressure greater than the surrounding atmospheric pressure is present within the housing and so that the panel is forced closed by surrounding atmospheric pressure when there is pressure within the housing less than the surrounding atmospheric pressure. The baffle is located within the housing near the first opening and it directs the flow of gaseous products of combustion through the housing from the first opening to the second opening.

DESCRIPTION OF THE PREFERRED EMBODIMENT

Figure 1:
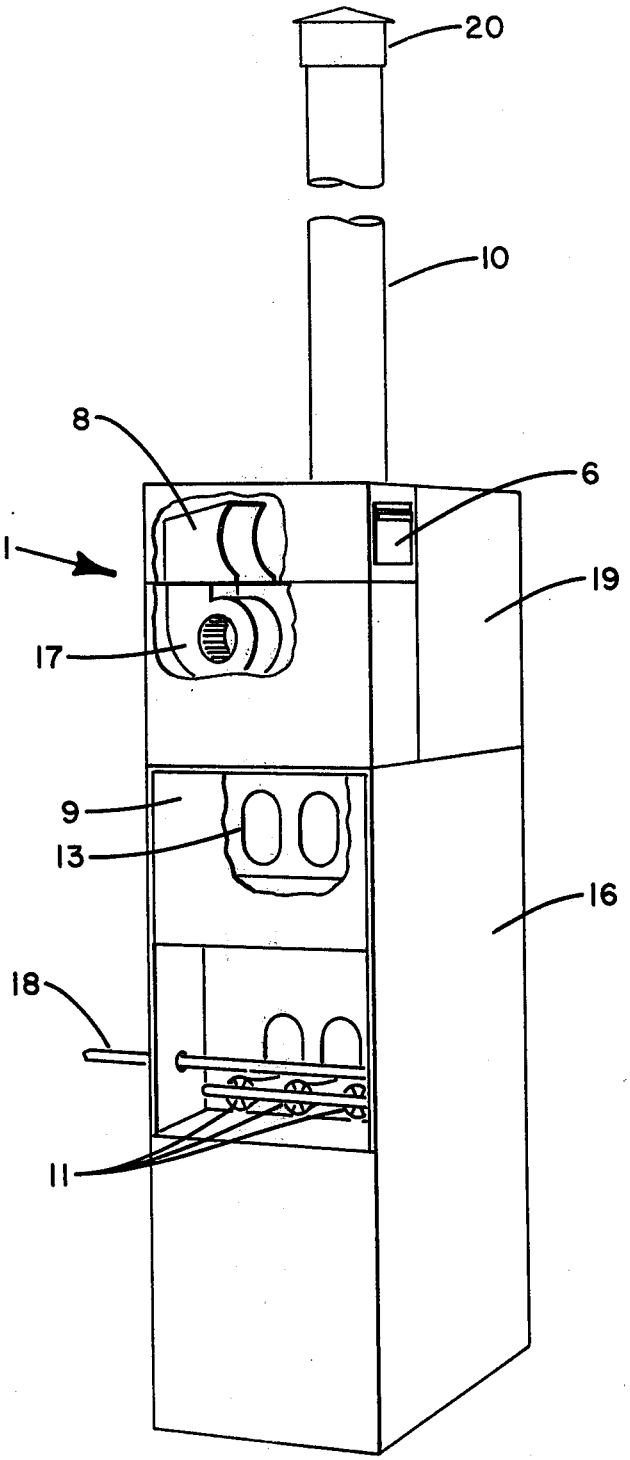
FIG. 1 is a schematic view of an induced draft furnace having the apparatus shown in FIG. 2 used as part of the system for venting the gaseous products of combustion from the furnace.
Figure 2:
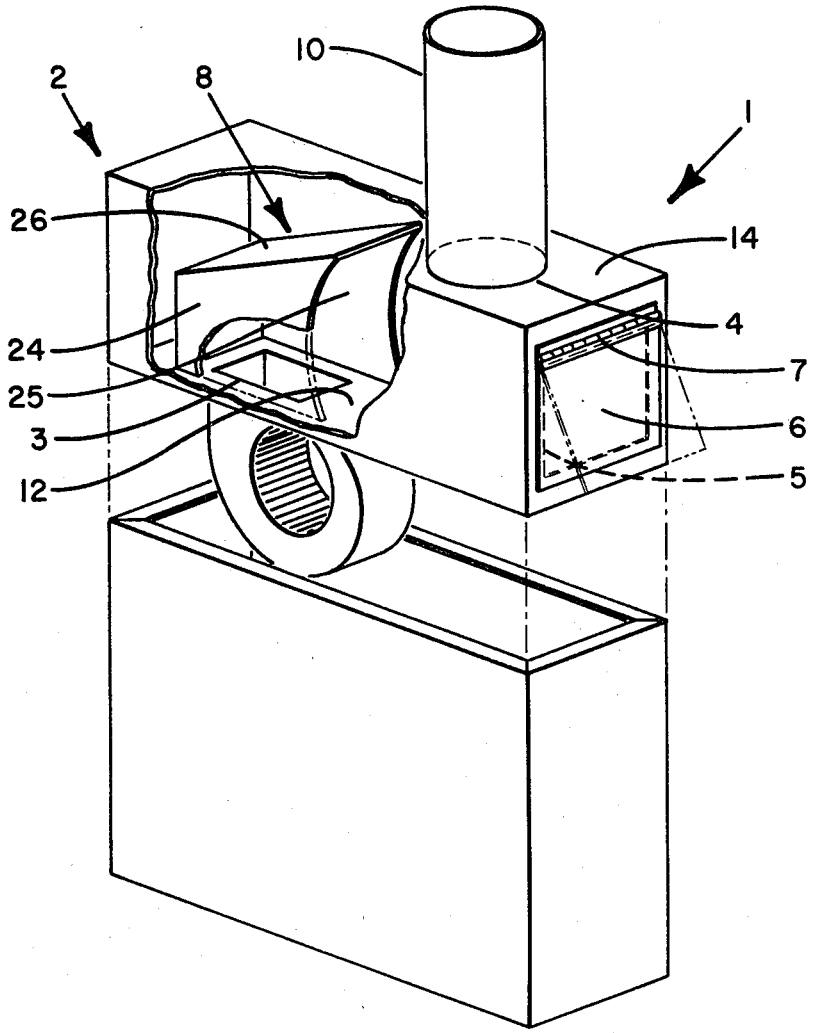
FIG. 2 is a broken away, perspective view of a venting apparatus constructed according to the principles of the present invention.

FIG. 1 is a schematic drawing of an induced draft furnace 16 whose products of combustion are discharged through the apparatus shown in FIG. 2. As shown in FIG. 1, an induced draft furnace 16, having burners 11 and heat exchangers 13, is connected to outlet vent 20 through a flue pipe 10 and a discharge box 1. The gaseous products of combustion, known as secondary fluid, are drawn through heat exchangers 13 and through a flue collector box 9 by a fan unit 17 which discharges the secondary fluid into the discharge box 1. The secondary fluid flows from the discharge box 1 through flue pipe 10 to an outlet vent 20 where the fluid is vented to the external atmosphere.

In operation, fuel is fed into the furnace 16 via inlet pipe 18. The fuel is burned with the burners 11 of the furnace 16 and heats circulation fluid, known as primary fluid, which passes over heat exchangers 13. The primary fluid is circulated through plenum 19 to heat an enclosure. The secondary fluid is drawn from the furnace 16 by fan unit 17 and flows into discharge box 1. The secondary fluid within discharge box 1 is discharged to flue pipe 10 and flows to outlet vent 20 where the fluid is vented to the external atmosphere. Under normal operating conditions the spillage damper or movable panel 6 of the discharge box 1 is closed and the air surrounding the discharge box 1 is prevented from entering the vent system.

However, if a back pressure developes at the outlet vent 20 the pressure increase is transmitted through flue pipe 10 into the discharge box 1 causing the movable panel 6 to be forced open thereby discharging the products of combustion within the box 1 to the surrounding atmosphere. Thus, the discharge box 1 having panel 6 provides a safety device for the furnace 16. Also, this apparatus prevents the undesirable flow of surrounding heated air into the vent system of the furnace 16 when the furnace 16 is operating normally.

FIG. 2 shows the details of the discharge box 1 depicted in FIG. 1. The discharge box 1 comprises a housing 2 having a first opening 3, a second opening 4, a third opening 5, and a movable panel 6 pivotally connected to the outside of the housing 2 above the third opening. The panel 6 is connected to the housing 2 by hinge 7. The broken lines shown in FIG. 2 indicate the position of the panel 6 when the panel 6 is forced open due to pressure within the box 1 exceeding the surrounding atmospheric pressure. The solid lines show the panel 6 in the closed position which is the position of the panel 6 when there is normal flow through the box 1.

Although the housing 2 is shown as being a rectangular box this structure is not required. The housing 2 may be shaped as a cylindrical box, a sphere or any other of a variety of shapes. The housing may be simply an extension or a structural modification of the flue pipe 10. The first opening 3 receives the gaseous products of combustion from a power combustion system for example, from an induced draft combustion system as shown in FIG. 1. The second opening 4 is connected to a conduit or flue pipe 10 for carrying the products of combustion from the housing 2 to an outlet vent such as the outlet vent 20 for an induced draft combustion system as shown in FIG. 1. The first opening 3 is located in the bottom wall 12 of the housing 2. The flue pipe 10 is connected to the opening 4 through the top wall 14 of the housing 2.

The panel 6 on discharge box 1 hangs in the down or closed position due to the weight of the panel 6. Springs, levers, or other such devices are not required to hold the panel closed. However, it may be desirable to slightly bias the panel to a closed position by slightly adjusting the slope of the side wall of the housing 2 having the panel 6. The panel 6 hangs in the closed position when the pressure within the box 1 is less than the surrounding atmospheric pressure. This negative pressure within the box 1 is the result of the natural draft due to the density difference between the hot secondary fluid within the vent system and the cool air surrounding the vent system.

Also, the baffle 8 within the discharge box 1 creates a Bernoulli effect as the secondary fluid flows through the box 1. That is, the velocity of the gases flowing through the box 1 relative to the stationary air in and around the box 1 results in a lower pressure in the flow stream relative to the surrounding air. This results in the surrounding air being drawn into the flow stream. Although it is preferable to include the baffle 8 in the discharge box 1 the inclusion of the baffle 8 is not required for the apparatus to operate properly. The apparatus can be designed to provide substantially the same performance regardless of whether the baffle 8 is included in the box 1. If the baffle 8 is not used the size of the box 1 must be increased to maintain proper flow through the box 1.

As shown in FIG. 2, the baffle 8 is a cowl located at the first opening 3 in the housing 2. However, baffle 8 may be any of a variety of geometrical configurations. The purpose of baffle 8 is simply to direct the flow of secondary fluid from the opening 3 to the opening 4. As shown in FIG. 2, the cowl or baffle 8 comprises a three-sided structure having a first side wall 24, a second side wall 25, and a top wall 26. The three walls 24, 25, and 26 may be made from thin metal plates which are attached to the housing 2 and to each other as shown in FIG. 2. Many variations could be devised for the shape of baffle 8 and the present invention is not intended to be limited to the shape of baffle 8 depicted in FIG. 2.

As shown in FIG. 2, the third opening 5, with movable panel 6 pivotally attached to the housing 2 by hinge 7, is preferably located in any vertical side wall of the housing 2. As shown in FIG. 2, the third opening 5 is located in a front vertical side wall between the top wall 14 and the bottom wall 12. The opening 3 is located in the back part of the bottom wall 12 with the baffle 8 directing flow from the opening 3 up to the opening 4 in the front part of top wall 14.

Thus, the present invention provides an apparatus for use in venting the gaseous products of combustion from an induced draft combustion system without drawing surrounding air into the vent system. The apparatus has the feature of allowing products of combustion from the combustion system to be vented to the surrounding atmosphere should a back pressure develop. This provides the safety features of a draft hood without the heat loss associated with a draft hood.

Although the present invention has been described as part of an induced draft combustion system, it is to be understood that the invention may be used with a forced draft combustion system and that various other modifications may be made. Therefore, while the present invention has been described in connection with an induced draft combustion system, it is to be understood that these various modifications may be made without departing from the scope of the invention heretofore described and claimed in the appended claims.

What is claimed is:

1. A flue gas discharge box for a combustion system having a fan unit which directs gaseous products of combustion from a heat exchanger assembly through said discharge box to a flue pipe, said discharge box comprising:

a housing sized and positioned to provide a negative pressure region through which the combustion products pass on their way to the flue pipe;

a first opening in the housing for receiving the combustion products directed to the housing by the fan unit;

a second opening in the housing connected to the flue pipe for discharging the combustion products from the housing into the flue pipe;

a third opening in a vertical sidewall of the housing; and a movable panel, pivotally connected to the housing above the third opening to hang in a substantially vertical position, for covering the opening in the housing during normal operation of the combustion system when the pressure in the housing is less than surrounding atmospheric pressure whereby the panel is forced closed by the pressure difference across the panel, and for uncovering the opening in the housing when the pressure in the housing is greater than surrounding atmospheric pressure whereby the panel is forced open by the pressure difference across the panel.

2. A flue gas discharge box for a combustion system as recited in claim 1, further comprising:

a baffle means located within the housing and positioned over the first opening for directing the flow of the combustion products from the first opening through the housing to the second opening, and for increasing the flow stream velocity of the combustion products to reduce the flow stream pressure of the combustion products relative to the pressure of substantially static gases in the housing.

3. A flue gas discharge box as recited in claim 2 wherein said baffle means is a cowl shaped deflector positioned over the first opening to deflect gas flow from the first opening toward the second opening.

* * * * *